US011855377B2

(12) United States Patent
Lee

(10) Patent No.: US 11,855,377 B2
(45) Date of Patent: Dec. 26, 2023

(54) SPRING PIN TERMINALS FOR AN ELECTRICAL CONNECTOR ASSEMBLY THAT PROVIDES MECHANICAL AND ELECTRICAL CONNECTIONS BETWEEN TWO ELECTRICALLY CONDUCTIVE STRUCTURES

(71) Applicant: Lear Corporation, Southfield, MI (US)

(72) Inventor: Hyoun Lee, Rochester, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/380,460

(22) Filed: Jul. 20, 2021

(65) Prior Publication Data

US 2023/0024376 A1 Jan. 26, 2023

(51) Int. Cl.
*H01R 13/24* (2006.01)
*H01R 12/79* (2011.01)

(52) U.S. Cl.
CPC ..... *H01R 13/2435* (2013.01); *H01R 12/79* (2013.01)

(58) Field of Classification Search
None
See application file for complete search history.

(56) References Cited

U.S. PATENT DOCUMENTS 3,307,139 A * 2/1967 Prise ..... H01R 12/613 439/495
3,845,236 A 10/1974 Anderson
3,920,303 A 11/1975 Pittman et al.
4,509,809 A 4/1985 Wang
4,695,112 A 9/1987 Maston et al.
5,308,262 A 5/1994 Chishima
5,807,130 A 9/1998 Miller et al.
6,027,009 A 2/2000 Shinchi
6,682,363 B1 1/2004 Chang
6,755,680 B2 6/2004 Okamura et al.
6,830,489 B2 12/2004 Aoyama
7,150,632 B2 * 12/2006 Lee ..... H01R 12/7076 439/66
7,955,112 B2 6/2011 Yang et al.
8,062,058 B1 11/2011 Moldoch et al.
9,300,085 B2 3/2016 Morello et al.
9,871,313 B2 1/2018 Saito et al.
10,236,614 B2 * 3/2019 Sugiyama ..... H01R 13/719
2006/0271136 A1 11/2006 Wojciechowicz
2022/0006220 A1 * 1/2022 Kim ..... H05K 1/14

* cited by examiner

*Primary Examiner* — Ross N Gushi
(74) *Attorney, Agent, or Firm* — MacMillan, Sobanski & Todd, LLC

(57) ABSTRACT

An electrical connector assembly includes a housing defining an interior space and a slot and a spring pin terminal disposed within the slot of the housing. The spring pin terminal includes a first contact portion, a second contact portion, and an intermediate portion that extends between the first contact portion and the second contact portion. The first contact portion includes a contact point that engages a first electrically conductive structure and a retention force support that engages a portion of the intermediate portion of the spring pin terminal. The second contact portion includes a contact point that engages a second electrically conductive structure and a retention force and alignment support that engages the intermediate portion of the spring pin terminal.

15 Claims, 10 Drawing Sheets

SPRING PIN TERMINALS FOR AN ELECTRICAL CONNECTOR ASSEMBLY THAT PROVIDES MECHANICAL AND ELECTRICAL CONNECTIONS BETWEEN TWO ELECTRICALLY CONDUCTIVE STRUCTURES

BACKGROUND OF THE INVENTION

This invention relates in general to electrical connector assemblies that provide mechanical and electrical connections between two electrically conductive structures, such as between a flat flexible conductor and a printed circuit board. In particular, this invention relates to an improved structure for a spring pin terminal that can be used in such an electrical connector assembly.

Many electrical systems are known in the art that include one or more electrically operated devices. For example, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. In many instances, electrical connector assemblies are provided on or with the electrical conductors for facilitating the installation, service, and removal of these electrically operated devices to and from the electrical system.

One conventional structure for an electrical connector assembly includes an outer housing (which is usually formed from an electrically non-conductive material) and a plurality of spring pin terminals (each of which is usually formed from an electrically conductive material) supported within the housing. The outer housing typically has first and second openings extending therethrough, and the spring pin terminals are supported within the housing adjacent to those first and second openings. The first opening facilitates the passage of a first electrically conductive structure (such as a flat flexible wire, cable, or other conductor having a plurality of electrically conductive traces) through the housing into engagement with the spring pin terminals supported therein. The second opening facilitates the passage of a second electrically conductive structure (such as a printed circuit board having a plurality of electrically conductive traces) through the housing into engagement with the spring pin terminals supported therein. Thus, the spring pin terminals supported within the electrical connector assembly provide electrically conductive connections between the traces of the first electrically conductive structure and the associated traces of the second electrically conductive structure.

In the past, the connections of the spring pin terminals to either or both of the first and second electrically conductive structures have been accomplished using a variety of specialized tools and/or specialized methods, such as soldering or crimping. Although effective, it has been found that the use of these known specialized tools and/or methods are relatively time-consuming and complicated to use. Thus, it would be desirable to provide an improved structure for a spring pin terminal that can be used in an electrical connector assembly that provides mechanical and electrical connections between two electrically conductive structures, such as between a flat flexible conductor and a printed circuit board.

SUMMARY OF THE INVENTION

This invention relates to an improved structure for a spring pin terminal that can be used in an electrical connector assembly that provides mechanical and electrical connections between two electrically conductive structures, such as between a flat flexible conductor and a printed circuit board. The spring pin terminal includes a first contact portion, a second contact portion, and an intermediate portion that extends between the first contact portion and the second contact portion. The first contact portion includes a contact point that is adapted to engage a portion of a first electrically conductive structure and a retention force support that is adapted to engage a portion of the intermediate portion of the spring pin terminal. The second contact portion includes a contact point that is adapted to engage a portion of a second electrically conductive structure and a retention force and alignment support that is adapted to engage a portion of the intermediate portion of the spring pin terminal.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
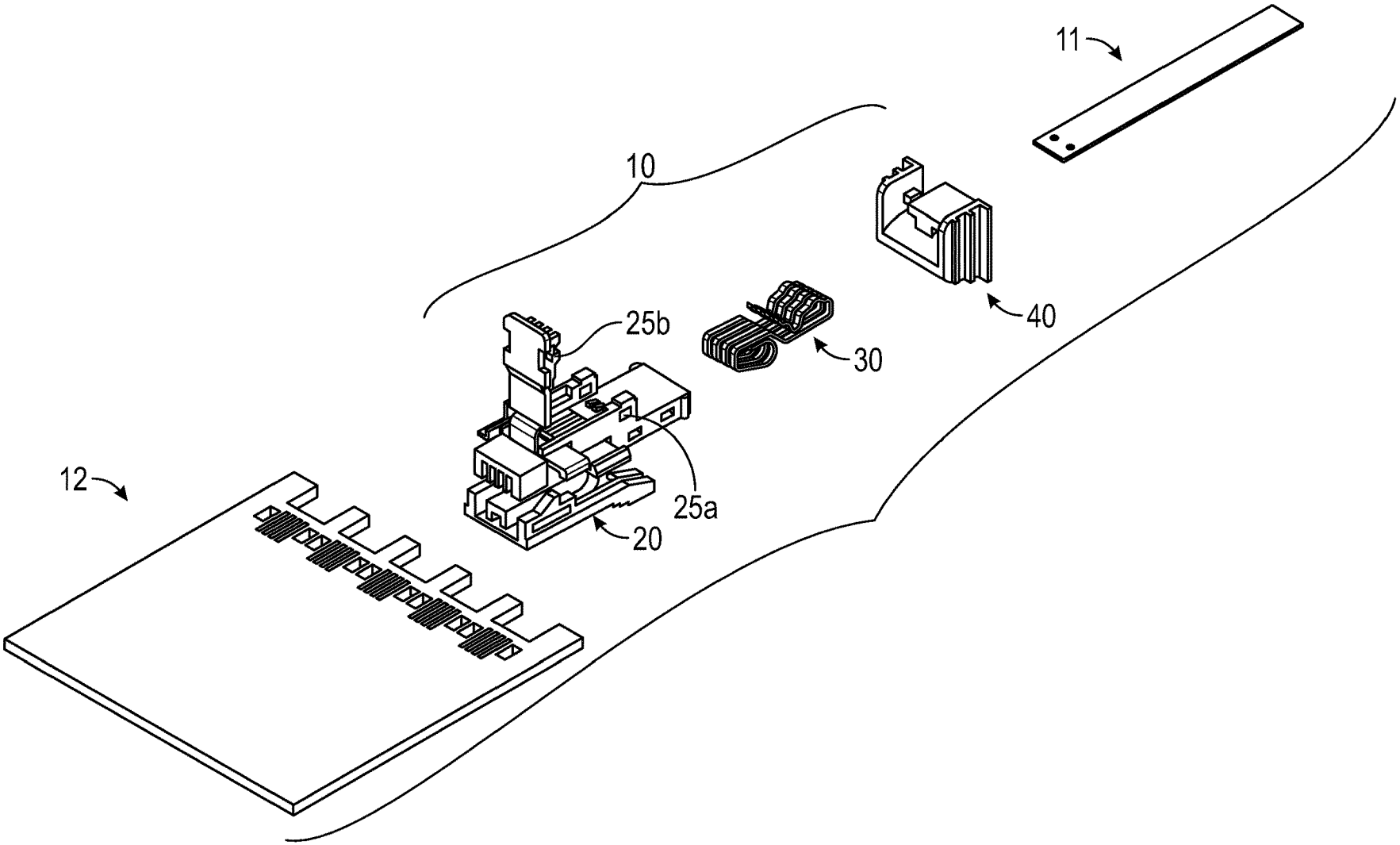
FIG. 1 is an exploded perspective view of an exemplary electrical connector assembly that provides mechanical and electrical connections between two electrically conductive structures, the electrical connector assembly including a housing, a plurality of spring pin terminals in accordance with this invention, and a connector position assurance.
Figure 2:
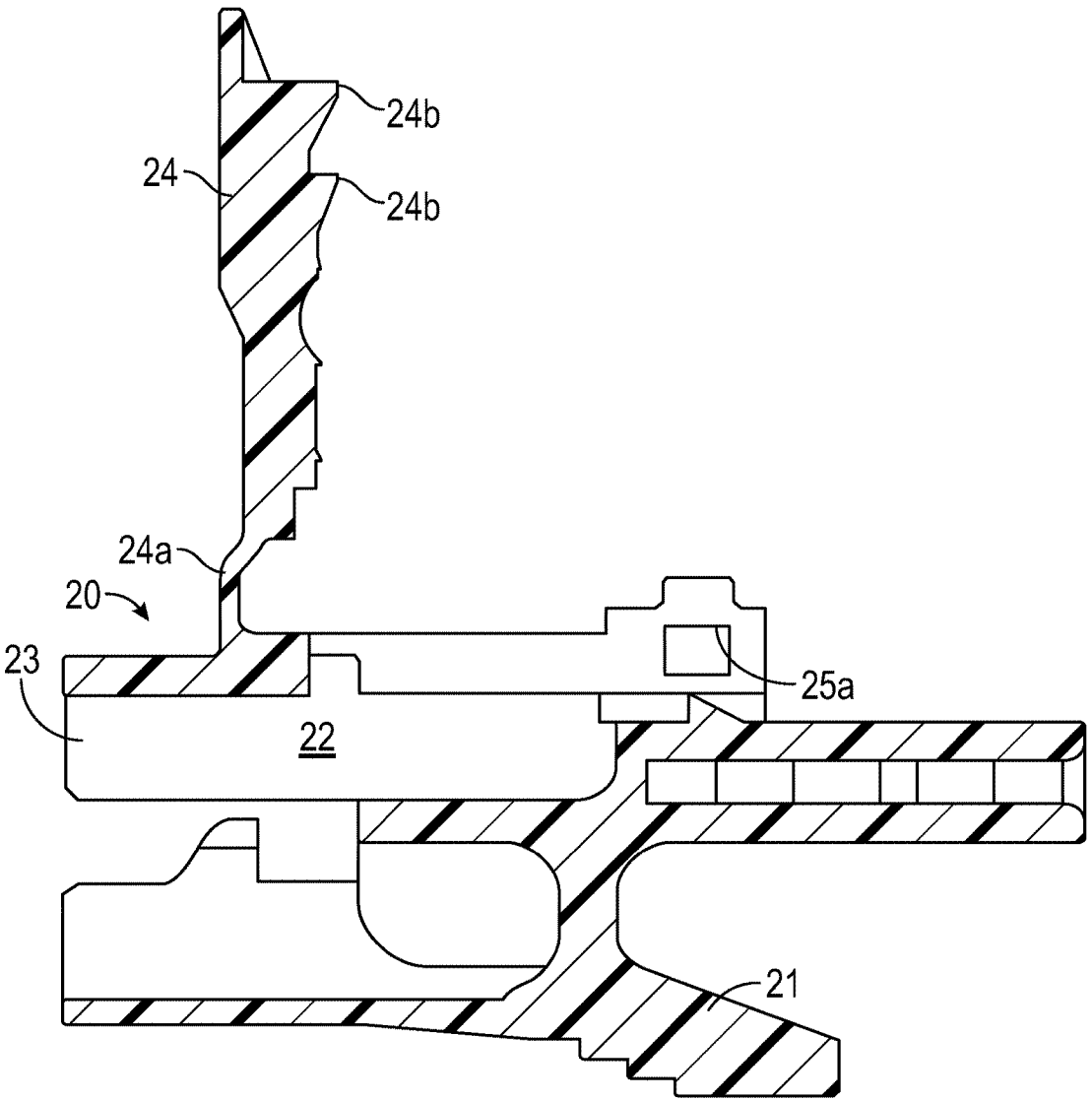
FIG. 2 is an enlarged side sectional view of the housing of the electrical connector assembly of FIG. 1 including a locking arm that is shown in an opened position.

Referring now to the drawings, there is illustrated in FIG. 1 an electrical connector assembly, indicated generally at 10, in accordance with this invention for providing a direct mechanical and electrical connection between a first electrically conductive structure 11 and a second electrically conductive structure 12. As will be explained in greater detail below, the structure of the electrical connector assembly 10 is, in large measure, conventional in the art. Thus, the scope of this invention is not intended to be limited to the specific structure for the electrical connector assembly 10 described and illustrated herein, or to electrical connector assemblies in general. On the contrary, as will become apparent below, this invention may be used in any desired environment for the purposes described below.

The illustrated first electrically conductive structure 11 is a flat flexible wire, cable, or other conductor including one or more electrically conductive traces 11*a* (best shown in FIG. 5) that are surrounded by an outer electrically non-conductive insulator 11*b*. However, the first electrically conductive structure 11 may have any other desired structure. The illustrated second electrically conductive structure 12 is a printed circuit board 12 including one or more electrically conductive traces 12*a* (best shown in FIG. 8) that are provided on an electrically non-conductive substrate 12*b*. However, the second electrically conductive structure 12 may have also any other desired structure.

As discussed above, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. The electrically conductive traces 11*a* of the first electrically conductive structure 11 and the electrically conductive traces 12*a* of the printed circuit board 12 can be used for this purpose.

The structure of the electrical connector assembly 10 will now be described in detail with reference to FIGS. 2 through 10. As shown therein, the electrical connector assembly 10 includes a housing, indicated generally at 20, that is preferably formed from an electrically non-conductive material, such as plastic. However, the housing 20 may be formed from any desired material. The illustrated housing 20 includes a body 21 that defines an interior space 22. Within the interior space 22 of the body 21, a plurality of dividers 23 is provided. In the illustrated embodiment, three such dividers 23 are formed integrally with the body 21. Together with opposed sides of the body 21, the three dividers 23 separate a portion of the interior space 22 of the body 21 into four adjacent and parallel slots. However, any desired number of such dividers 23 may be provided to separate the portion of the interior space 22 of the body 21 into any desired number of such slots. The purposes for the dividers 23 and the slots defined thereby will be explained below.

A locking arm 24 is also provided on the body 21 of the housing 20. In the illustrated embodiment, the locking arm 24 is formed integrally with a living hinge 24*a* that, in turn, is formed integrally with the body 21 of the housing 20. Thus, the illustrated locking arm 24 is supported on the body 21 of the housing 20 for pivoting movement relative thereto between an unlocked position (illustrated in FIGS. 1, 2, 4, 5, and 6) and a locked position (illustrated in FIGS. 7 through 10). However, the locking arm 24 may be supported on the body 21 of the housing 20 or otherwise provided in any desired manner. The illustrated locking arm 24 has a pair of barbs 24*b* provided on a surface thereof. Additionally, mating retainer portions 25*a* and 25*b* (see FIG. 1) are respectively provided on the body 21 and the locking arm 24. The purposes for the locking arm 24, the barbs 24*b*, and the retainer portions 25*a* and 25*b* will also be explained in detail below.

The electrical connector assembly 10 also includes one or more spring pin terminals, indicated generally at 30 in FIG. 1. Preferably, the number of such spring pin terminals 30 is the same as the number of slots provided in the interior space 22 of the body 21 of the housing 20. Thus, in the illustrated embodiment, the electrical connector assembly 10 includes four of such spring pin terminals 30. However, a greater or lesser number of such spring pin terminals 30 may be provided. As will be explained in detail below, each of the spring pin terminals 30 includes a first contact portion that is adapted to engage a portion of the first electrically conductive structure (i.e., one of the traces 11*a* of the flat flexible conductor 11), a second contact portion that is adapted to engage a portion of the second electrically conductive structure (i.e., one of the traces 12*a* of the printed circuit board 12), and an intermediate contact portion that extends between the first contact portion and the second contact portion.

Figure 3A:
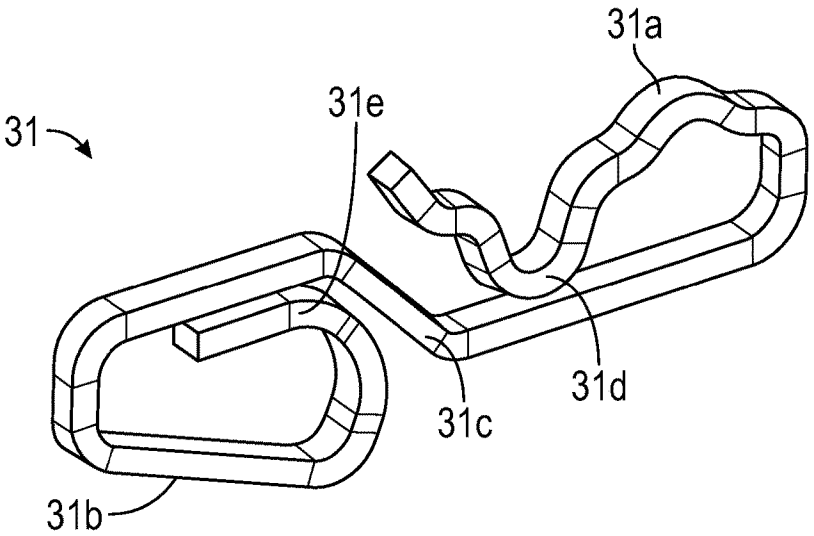
FIG. 3A is a perspective view of a first embodiment of one of the plurality of spring pin terminals of FIG. 1.

FIG. 3A illustrates a first embodiment, indicated generally at 31, of one of the spring pin terminals 30 of FIG. 1. As shown therein, the first embodiment of the spring pin terminal 31 includes a first contact portion 31*a*, a second contact portion 31*b*, and an intermediate portion 31*c* that extends between the first contact portion 31*a* and the second contact portion 31*b*. In this first embodiment of the spring pin terminal 31, the first contact portion 31*a* includes a single curved contact point (which is adapted to engage one of the traces 11*a* of the flat flexible conductor 11 when inserted within the body 21 of the housing 20 as described below) and a curved retention force support 31*d* (which is adapted to engage a portion of the intermediate portion 31*c* of the spring pin terminal 31 as also described below). The second contact portion 31*b* includes a linear contact point (which is adapted to engage one of the traces 12*a* of the printed circuit board 12 when inserted within the body 21 of the housing 20 as described below) and a curved retention force and alignment support 31*e* (which is adapted to engage a portion of the intermediate portion 31*c* of the spring pin terminal 31 as also described below). Thus, as will be explained in detail below, the first contact portion 31*a* and the second contact portion 31*b* are resiliently urged into engagement with the associated traces 11*a* and 12*a* of the flat flexible conductor 11 and the printed circuit board 12.

Figure 3B:
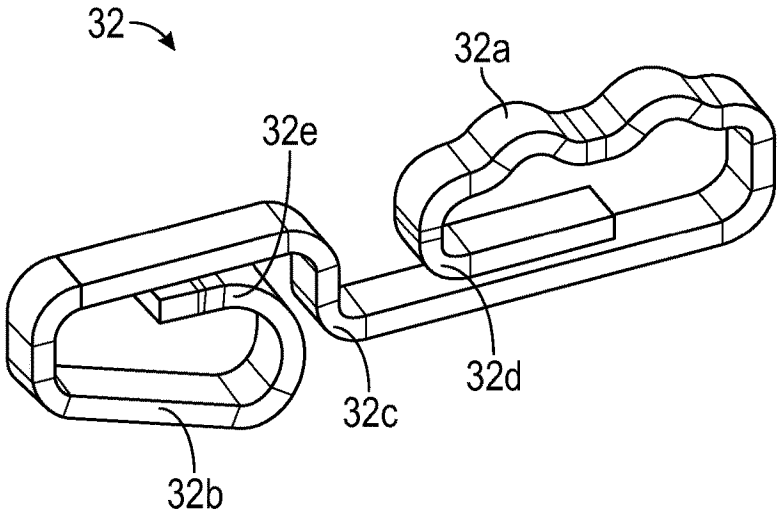
FIG. 3B is a perspective view of second embodiment of one of the plurality of spring pin terminals of FIG. 1.

FIG. 3B illustrates a second embodiment, indicated generally at 32, of one of the spring pin terminals 30 of FIG. 1. As shown therein, the second embodiment of the spring pin terminal 32 includes a first contact portion 32*a*, a second contact portion 32*b*, and an intermediate portion 32*c* that extends between the first contact portion 32*a* and the second contact portion 32*b*. In this second embodiment of the spring pin terminal 32, the first contact portion 32*a* includes two curved contact points (which are both adapted to engage one of the traces 11*a* of the flat flexible conductor 11 when inserted within the body 21 of the housing 20 as described below) and an angled retention force support 32*d* (which is adapted to engage the intermediate portion 32*c* of the spring pin terminal 32 as also described below). The second contact portion 32*b* includes a linear contact point (which is adapted to engage one of the traces 12*a* of the printed circuit board 12 when inserted within the body 21 of the housing 20 as described below) and a curved retention force and alignment support 32*e* (which is adapted to engage the intermediate portion 32*c* of the spring pin terminal 32). Thus, as will be explained in detail below, the first contact portion 32*a* and the second contact portion 32*b* are resiliently urged into engagement with the associated traces 11*a* and 12*a* of the flat flexible conductor 11 and the printed circuit board 12.

Figure 3C:
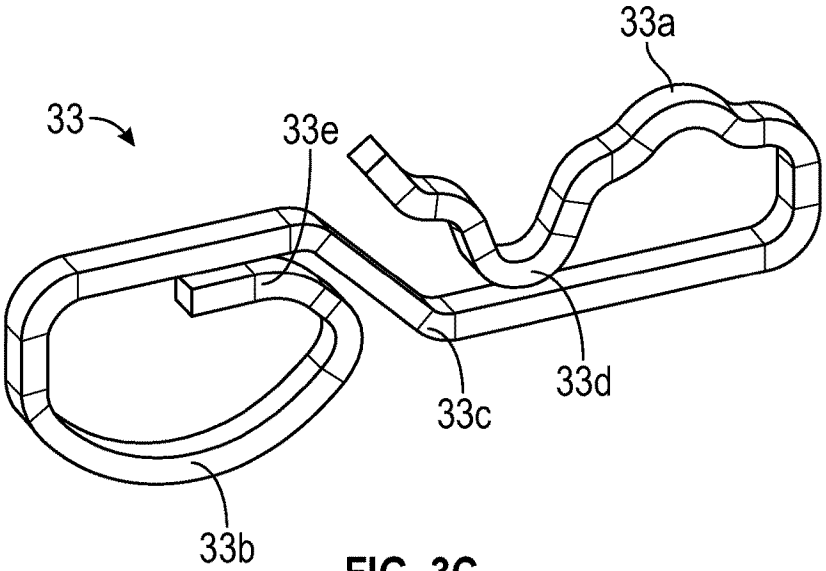
FIG. 3C is a perspective view of a third embodiment of one of the plurality of spring pin terminals of FIG. 1.

FIG. 3C illustrates a third embodiment, indicated generally at 33, of one of the spring pin terminals 30 of FIG. 1. As shown therein, the third embodiment of the spring pin terminal 33 includes a first contact portion 33*a*, a second contact portion 33*b*, and an intermediate portion 33*c* that extends between the first contact portion 33*a* and the second contact portion 33*b*. In this third embodiment of the spring pin terminal 33, the first contact portion 33*a* includes a single curved contact point (which is adapted to engage one of the traces 11*a* of the flat flexible conductor 11 when inserted within the body 21 of the housing 20 as described below) and a curved retention force support 33*d* (which is adapted to engage the intermediate portion 33*c* of the spring pin terminal 33 as also described below). The second contact portion 33*b* includes a curved contact point (which is adapted to engage one of the traces 12*a* of the printed circuit board 12 when inserted within the body 21 of the housing 20 as described below) and an angled retention force and alignment support 33*e* (which is adapted to engage the intermediate portion 33*c* of the spring pin terminal 33 as also described below). Thus, as will be explained in detail below, the contact portion 33*a* and the second contact portion 33*b* are resiliently urged into engagement with the associated traces 11*a* and 12*a* of the flat flexible conductor 11 and the printed circuit board 12.

The electrical connector assembly 10 further includes a connector position assurance, indicated generally at 40. The structure and manner of operation of the connector position assurance is generally conventional in the art and will be described in further detail below.

The manner in which the electrical connector assembly 10 is assembled will now be described in detail with reference to FIGS. 4 through 10. FIGS. 4 through 7 show how the first electrically conductive structure 11 is assembled with the housing 20 of the electrical connector assembly 10. Although FIGS. 4 through 10 illustrate the use of the first embodiment 31 of the plurality of spring pin terminals 30 therein, it will be appreciated that either, or both, of the second and third embodiments 32 and 33 of the spring pin terminals 30 may be assembled in the same manner with the housing 20 of the electrical connector assembly 10. Alternatively, the second and third embodiments 32 and 33 of the spring pin terminals 30 may be assembled in different manners with the housing 20 of the electrical connector assembly 10, depending upon the structure, shape, and/or size of the electrical connector assembly 10.

Figure 4:
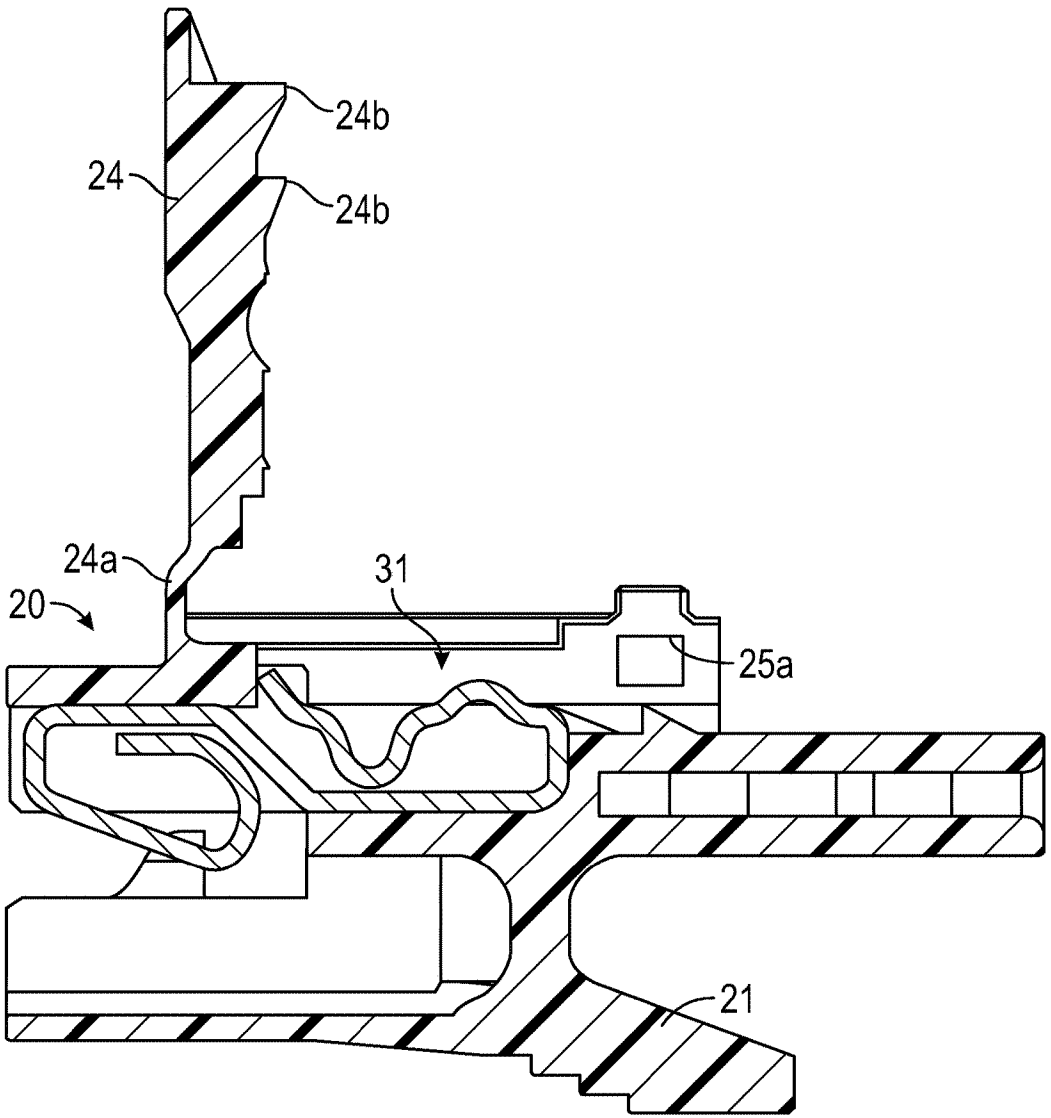
FIG. 4 is a side sectional view showing the housing of the electrical connector assembly of FIG. 2 after assembly with the first embodiment of the spring pin terminal of FIG. 3A.

Initially, the locking arm 24 of the body 21 of the housing 20 is moved to the unlocked position shown in FIG. 4. Then, as also shown in FIG. 4, each of the plurality of spring pin terminals 31 is inserted within the interior space 22 of the body 21 so as to be supported therein by the housing 20. More specifically, each of the spring pin terminals 31 is inserted within a respective one of the slots defined within the interior space 22 by the dividers 23 of the body 21 of the housing 20. To facilitate the assembly process, the housing 20 and the spring pin terminals 31 are preferably sized and shaped such that each of the spring pin terminals 31 is resiliently retained within its associated slot within the interior space 22 of the housing 20 when inserted therein, although such is not required.

Figure 5:
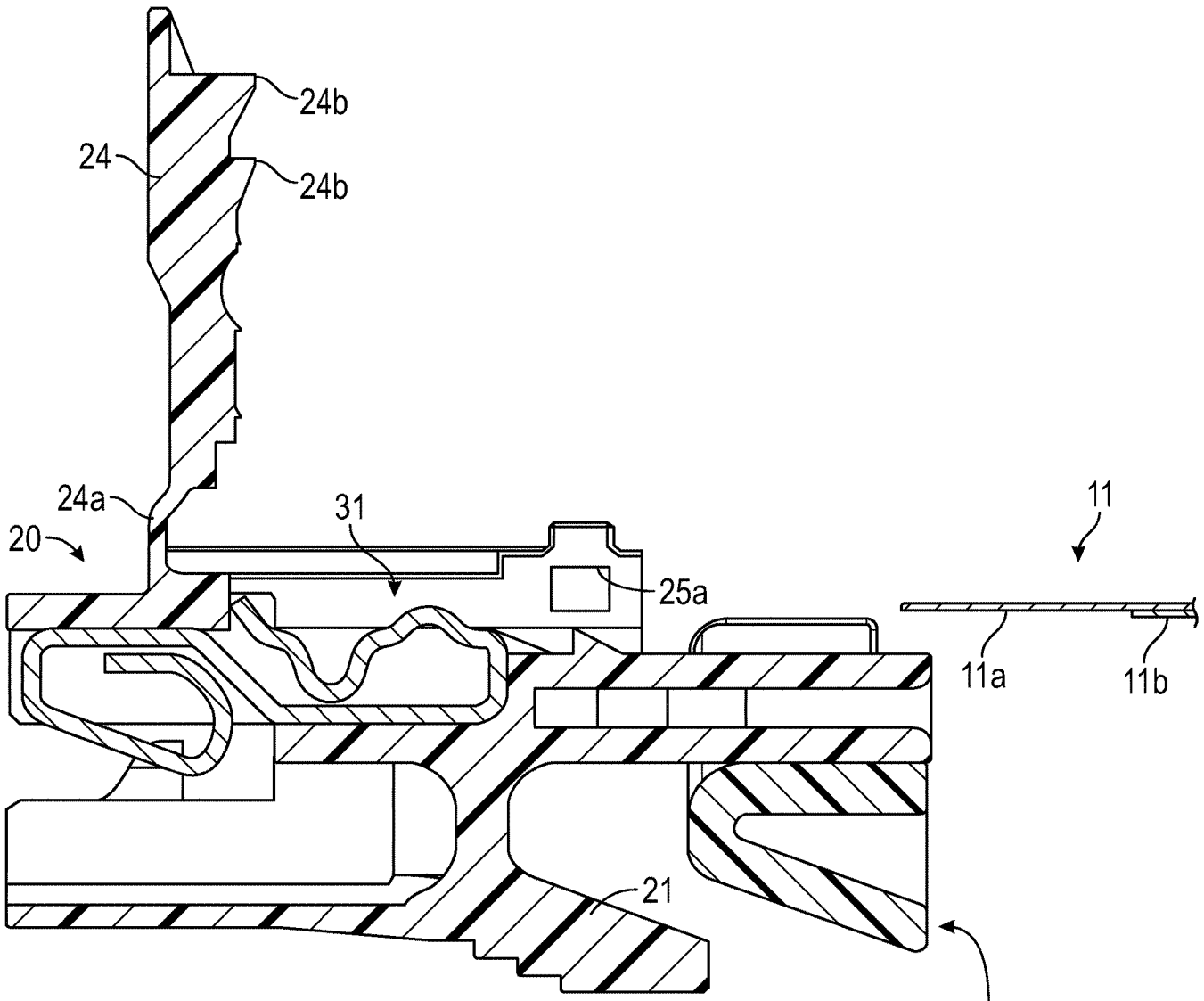
FIG. 5 is an exploded side sectional view showing the housing of the electrical connector assembly of FIG. 4 after assembly with the connector position assurance of FIG. 1 (shown in an unlocked position) and before assembly with the flat flexible conductor of FIG. 1.
Figure 6:
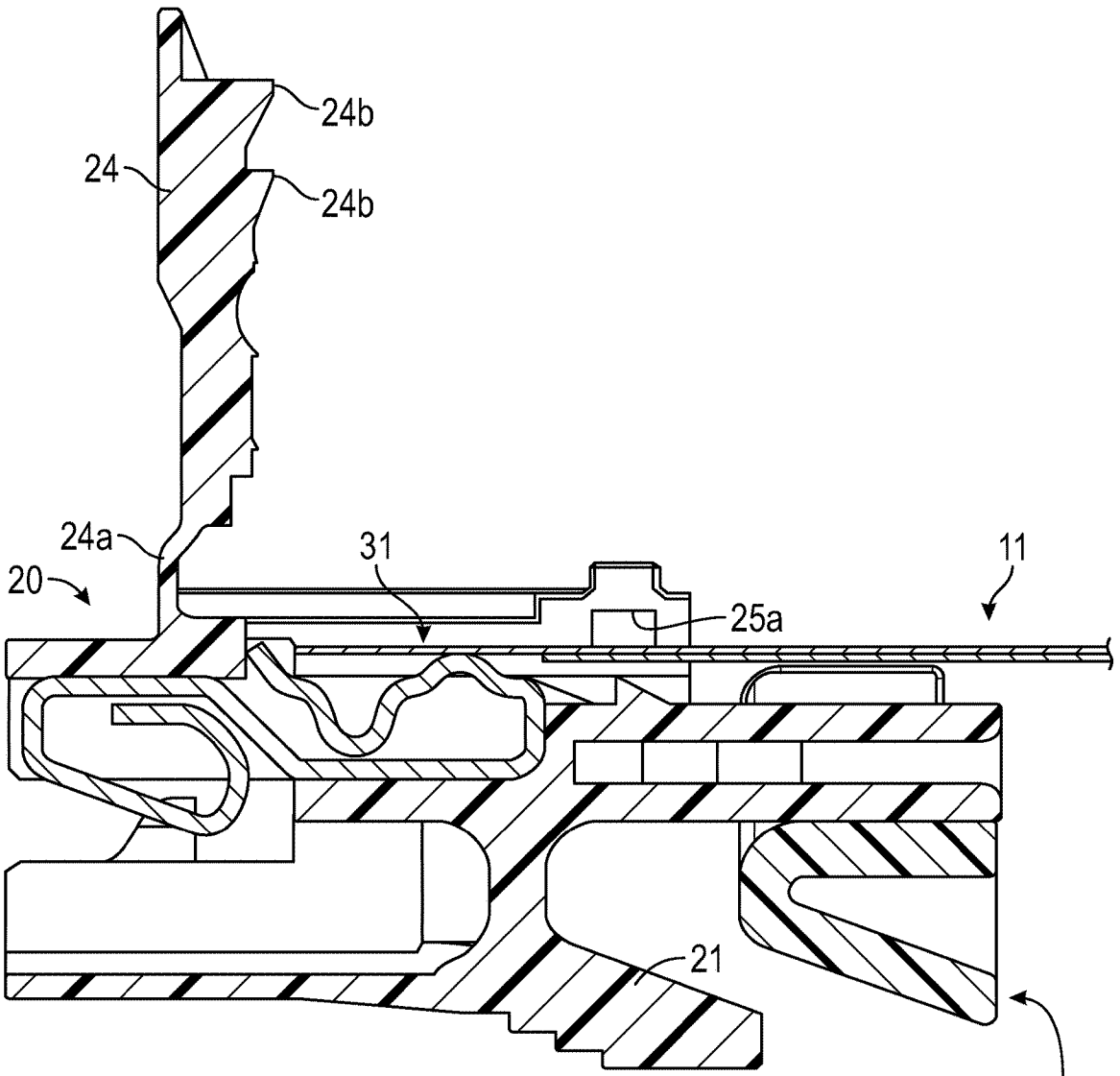
FIG. 6 is a side sectional view showing the housing of the electrical connector assembly of FIG. 5 after assembly with the flat flexible conductor and before the locking arm has been moved from the opened position to a closed position.

Next, the connector position assurance 40 is aligned with (as shown in FIG. 5) and assembled onto (as shown in FIG. 6) a portion of the body 21 of the housing 20. To accomplish this, the connector position assurance 40 is initially located in an unlocked position relative to the body 21 of the housing 20, as shown in FIG. 5. As also shown in FIG. 5, the first electrically conductive structure 11 is preliminarily positioned relative to the body 21 of the housing 20 such that the traces 11*a* provided on the first electrically conductive structure 11 are respectively aligned with the spring pin terminals 31 supported within the interior space 22 of the body 21 of the housing 20.

Thereafter, as shown in FIG. 6, the first electrically conductive structure 11 is moved so as to be inserted into engagement with the body 21 of the housing 20. When so moved, the traces 11*a* provided on the first electrically conductive structure 11 are respectively disposed adjacent to the first contact portions 31*a* of the spring pin terminals 31.

Figure 7:
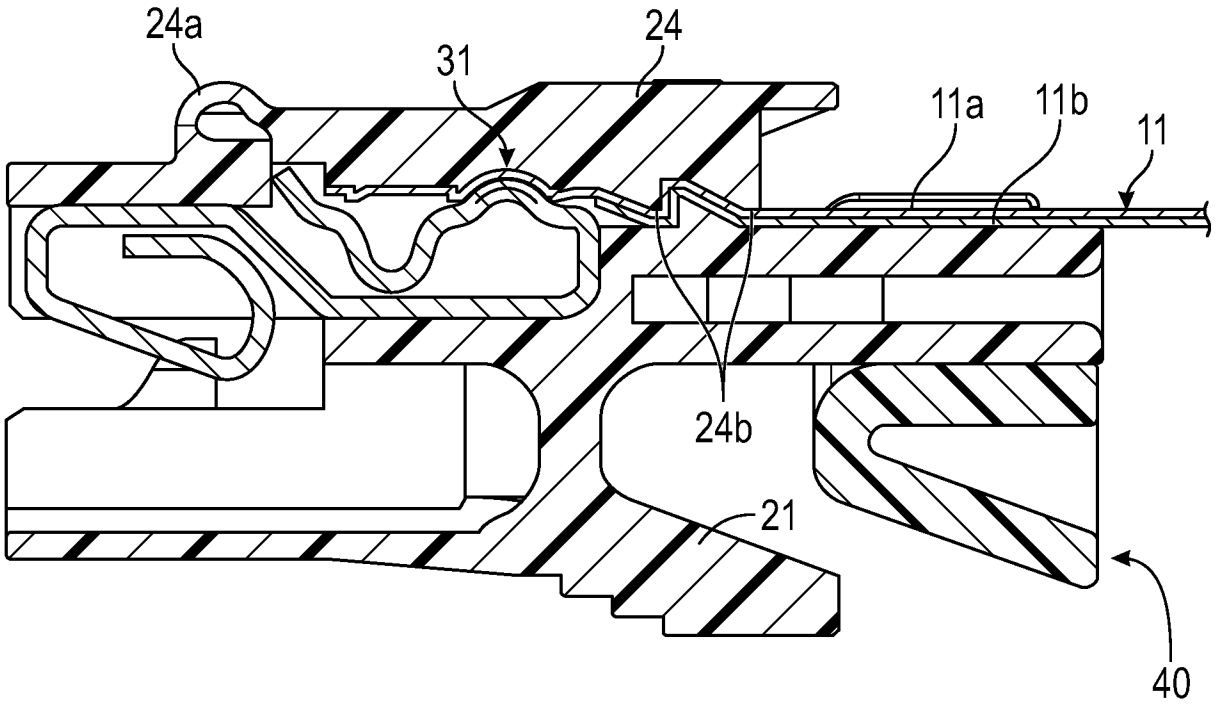
FIG. 7 is a side sectional view showing the housing of the electrical connector assembly of FIG. 6 after the locking arm has been moved from the opened position to the closed position.

FIG. 7 illustrates the final step in the process of assembling the first electrically conductive structure 11 with the housing 20 of the electrical connector assembly 10. As shown therein, the locking arm 24 provided on the body 21 of the housing 20 is moved from the opened position to the closed position. When so moved, the retainer portions 25*a* and 25*b* engage one another so as to positively retain the locking arm 24 in the closed position relative to the body 21 of the housing 20, although such is not required. Also, the barbs 24*b* provided on the locking arm 24 engage respective portions of the first electrically conductive structure 11 to prevent the first electrically conductive structure 11 from being removed from the housing 20 of the electrical connector assembly 10 while the locking arm 24 is in the closed position.

When located in the closed position, the locking arm 24 urges the traces 11*a* provided on the first electrically conductive structure 11 into engagement with the respective single curved contact points provided on the first contact portions 31*a* of the spring pin terminals 31. At the same time, the locking arm 24 causes the curved retention force supports provided on the first contact portions 31*a* of the spring pin terminals 31 to resiliently engage the respective intermediate portions 31*c* of the spring pin terminals 31. Consequently, the traces 11*a* provided on the first electrically conductive structure 11 are mechanically and electrically connected to the respective first contact portions 31*a* of the spring pin terminals 31.

Figure 8:
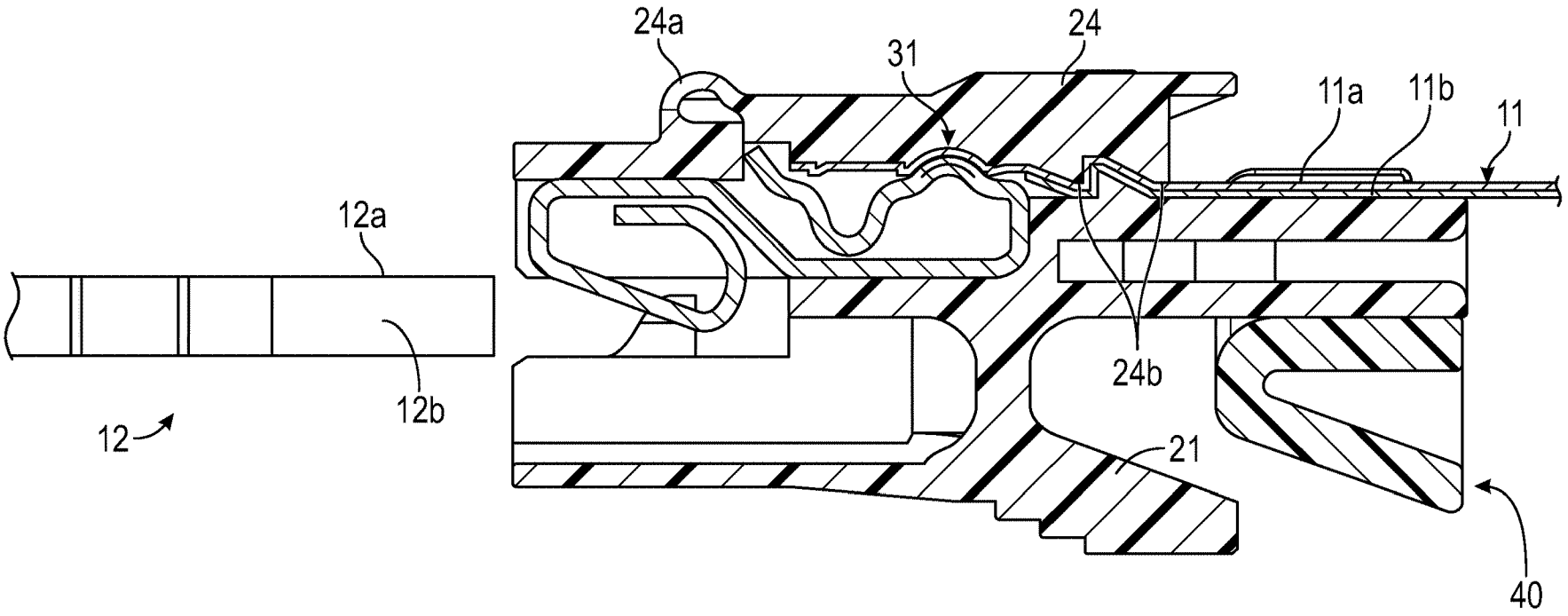
FIG. 8 is an exploded side sectional view showing the housing of the electrical connector assembly of FIG. 7 before assembly with the printed circuit board of FIG. 1.
Figure 9:
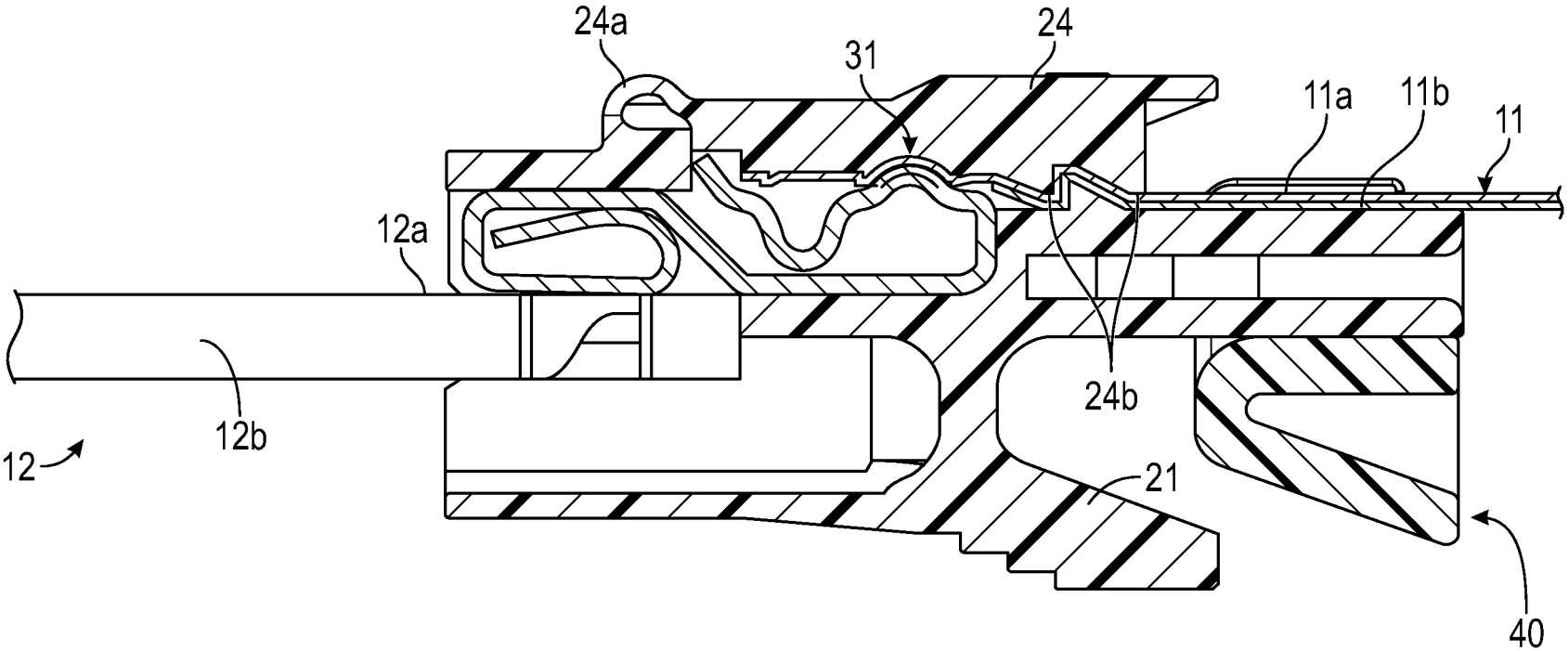
FIG. 9 is a side sectional view showing the housing of the electrical connector assembly of FIG. 8 after assembly with the printed circuit board.
Figure 10:
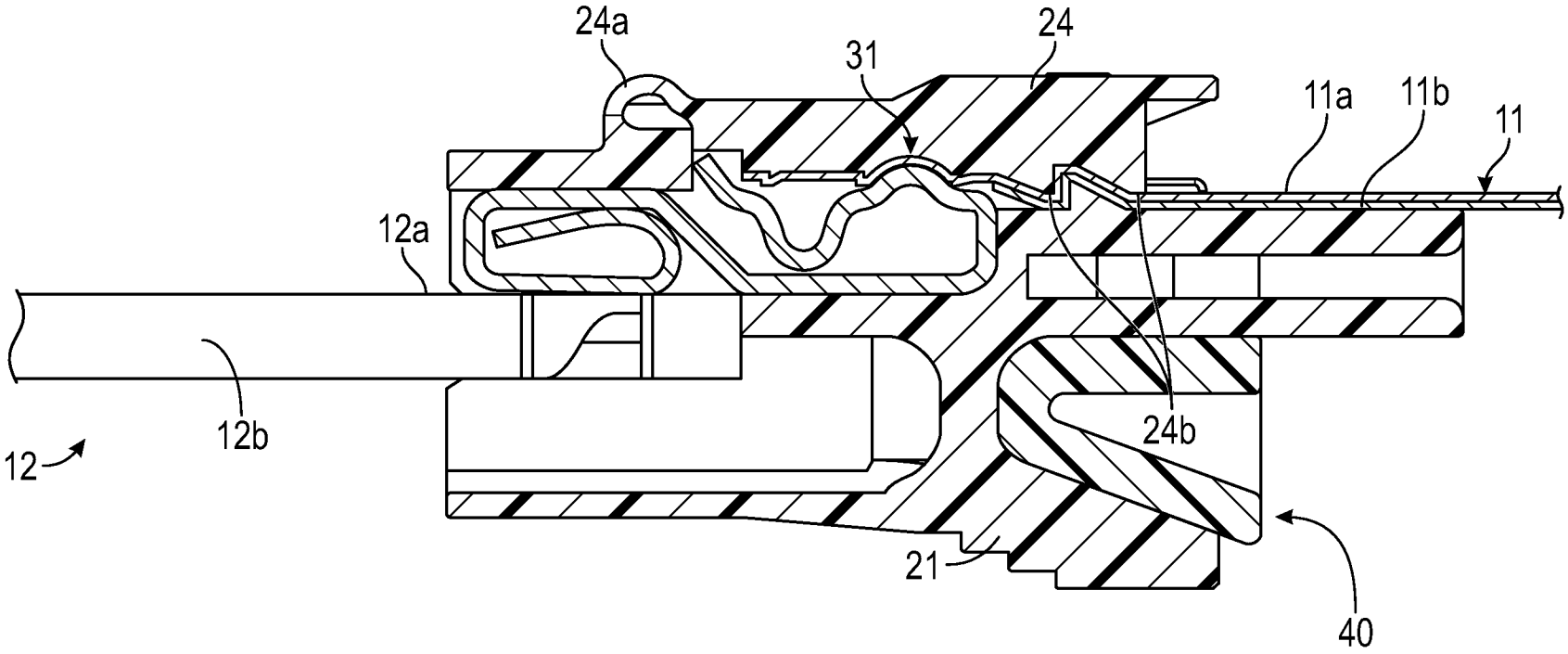
FIG. 10 is a side sectional view showing the connector position assurance of FIG. 9 after being moved from the unlocked position to a locked position.

FIGS. 8 through 10 illustrate how the second electrically conductive structure 12 is assembled with the housing 20 of the electrical connector assembly 10. As shown in FIG. 8, the second electrically conductive structure 12 is preliminarily positioned relative to the body 21 of the housing 20 such that the traces 12*a* provided on the second electrically conductive structure 12 are respectively aligned with the spring pin terminals 31 supported within the interior space 22 of the body 21 of the housing 20. Thereafter, as shown in FIG. 9, the second electrically conductive structure 12 is moved into engagement with the body 21 of the housing 20. When so moved, the traces 12*a* provided on the second electrically conductive structure 12 are respectively moved into engagement with the linear contact points provided on the second contact portions 31*b* of the spring pin terminals 31. At the same time, the retention force and alignment supports 31*e* provided on the second contact portions 31*b* of the spring pin terminals 31 engage the intermediate portions 31*c* of the spring pin terminals 31. Consequently, the traces 12*a* provided on the second electrically conductive structure 12 are positively and electrically connected to the respective second contact portions 31*b* of the spring pin terminals 31.

If desired, the body 21 of the housing 20 may be structured to facilitate the insertion of the second electrically conductive structure 12 therewith. To accomplish this, the body 21 of the housing 20 may be provided with a cantilevered arm portion having an end (located near reference number 21 in the illustrated embodiment). By applying a force against the end of that cantilevered arm portion toward the body of the housing 20 (i.e., upwardly when viewing FIG. 8), the opposite end of the housing 20 will be flexed in the opposite direction (i.e., downwardly when viewing FIG. 8), thus slightly expanding the opening into which the second electrically conductive structure 12 is inserted. However, the body 21 of the housing 20 may be provided with any other structure for accomplishing this purpose.

Lastly, as shown in FIG. 10, the connector position assurance 40 is moved from the unlocked position to a locked position relative to the body 21 of the housing 20. As is well known in the art, the connector position assurance 40 provides a mechanism to positively ensure that the components of the electrical connector assembly 10 are properly mated with one another.

The principle and mode of operation of this invention have been explained and illustrated in its preferred embodiments. However, it must be understood that this invention may be practiced otherwise than as specifically explained and illustrated without departing from its spirit or scope.

What is claimed is:

1. An electrical connector assembly that is adapted to provide mechanical and electrical connections between a first electrically conductive structure and a second electrically conductive structure, the electrical connector assembly comprising:

a housing including a body that defines a slot and a locking arm that is supported on the body for movement between unlocked and locked positions; and a spring pin terminal disposed within the slot and retained therein by the locking arm when the locking arm is located in the locked position relative to the housing, wherein:

the spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion;

the first contact portion of the spring pin terminal includes (1) a single curved contact point that is adapted to engage first electrically conductive structure and (2) a curved retention force support that engages the intermediate portion of the spring pin terminal; and the second contact portion of the spring pin terminal includes (1) a contact point that is adapted to engage the second electrically conductive structure and (2) a retention force and alignment support that engages the intermediate portion of the spring pin terminal.

2. The electrical connector assembly defined in claim 1 wherein the body of the housing defines a plurality of slots, and wherein a spring pin terminal is disposed within each of the plurality of slots.

3. The electrical connector assembly defined in claim 2 wherein each spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion.

4. The electrical connector assembly defined in claim 3 wherein the first contact portion of each spring pin terminal includes (1) a single curved contact point that is adapted to engage first electrically conductive structure and (2) a curved retention force support that engages the intermediate portion of that spring pin terminal.

5. The electrical connector assembly defined in claim 4 wherein the second contact portion of each spring pin terminal includes (1) a contact point that is adapted to engage the second electrically conductive structure and (2) a retention force and alignment support that engages the intermediate portion of that spring pin terminal.

6. An electrical connector assembly that is adapted to provide mechanical and electrical connections between a first electrically conductive structure and a second electrically conductive structure, the electrical connector assembly comprising:

a housing including a body that defines a slot and a locking arm that is supported on the body for movement between unlocked and locked positions; and a spring pin terminal disposed within the slot and retained therein by the locking arm when the locking arm is located in the locked position relative to the housing, wherein:

the spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion;

the first contact portion of the spring pin terminal includes (1) two curved contact points that are adapted to engage first electrically conductive structure and (2) a angled retention force support that engages the intermediate portion of the spring pin terminal; and the second contact portion of the spring pin terminal includes (1) a linear contact point that is adapted to engage the second electrically conductive structure and (2) a curved retention force and alignment support that engages the intermediate portion of the spring pin terminal.

7. The electrical connector assembly defined in claim 6 wherein the body of the housing defines a plurality of slots, and wherein a spring pin terminal is disposed within each of the plurality of slots.

8. The electrical connector assembly defined in claim 7 wherein each spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion.

9. The electrical connector assembly defined in claim 8 wherein the first contact portion of each spring pin terminal includes (1) two curved contact points that are adapted to engage first electrically conductive structure and (2) an angled retention force support that engages the intermediate portion of that spring pin terminal.

10. The electrical connector assembly defined in claim 9 wherein the second contact portion of each spring pin terminal includes (1) a linear contact point that is adapted to engage the second electrically conductive structure and (2) a curved retention force and alignment support that engages the intermediate portion of that spring pin terminal.

11. An electrical connector assembly that is adapted to provide mechanical and electrical connections between a first electrically conductive structure and a second electrically conductive structure, the electrical connector assembly comprising:

a housing including a body that defines a slot and a locking arm that is supported on the body for movement between unlocked and locked positions; and a spring pin terminal disposed within the slot and retained therein by the locking arm when the locking arm is located in the locked position relative to the housing, wherein:

the spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion;

the first contact portion of the spring pin terminal includes (1) a single curved contact point that is adapted to engage the first electrically conductive structure and (2) a curved retention force support that engages the intermediate portion of the spring pin terminal; and the second contact portion of the spring pin terminal includes (1) a curved contact point that is adapted to engage the second electrically conductive structure and (2) an angled retention force and alignment support that engages the intermediate portion of the spring pin terminal.

12. The electrical connector assembly defined in claim 11 wherein the body of the housing defines a plurality of slots, and wherein a spring pin terminal is disposed within each of the plurality of slots.

13. The electrical connector assembly defined in claim 12 wherein each spring pin terminal includes (1) a first contact portion that is adapted to engage the first electrically conductive structure, (2) a second contact portion that is adapted to engage the second electrically conductive structure, and (3) an intermediate portion that extends between the first contact portion and the second contact portion.

14. The electrical connector assembly defined in claim 13 wherein the first contact portion of each spring pin terminal includes (1) a single curved contact point that is adapted to engage first electrically conductive structure and (2) a curved retention force support that engages the intermediate portion of that spring pin terminal.

15. The electrical connector assembly defined in claim 14 wherein the second contact portion of each spring pin terminal includes (1) a curved contact point that is adapted to engage the second electrically conductive structure and (2) an angled retention force and alignment support that engages the intermediate portion of that spring pin terminal.

* * * * *